United States Patent [19]

Head

[11] Patent Number: 4,885,193

[45] Date of Patent: Dec. 5, 1989

[54] ART FORM AND METHOD OF PRODUCING SAME

[76] Inventor: Richard M. Head, 7753 Bisbee Rd., Scottsdale, Ariz. 85258

[21] Appl. No.: 115,828

[22] Filed: Nov. 2, 1987

[51] Int. Cl.[4] ..... B43L 9/00

[52] U.S. Cl. ..... 428/14; 40/453; 428/30; 434/81

[58] Field of Search ..... 428/13, 14, 30; 40/427, 40/453, 454; 434/81

[56] References Cited

U.S. PATENT DOCUMENTS

| | | | |
|---|---|---|---|
| 1,561,149 | 11/1925 | Gage | 428/31 XR |
| 2,483,744 | 10/1949 | Vernon | 428/14 |
| 2,529,413 | 11/1950 | Petersen | 428/66 XR |
| 2,983,640 | 5/1961 | Knoll et al. | 428/116 XR |
| 3,014,302 | 12/1961 | Hughes | 428/14 XR |
| 3,535,791 | 10/1970 | Oppenheim | 428/187 XR |
| 3,589,045 | 6/1971 | Rakowsky | 40/441 |
| 4,789,573 | 12/1988 | Jenkinson | 428/30 XR |

*Primary Examiner*—Henry F. Epstein
*Attorney, Agent, or Firm*—Richard R. Mybeck

[57] ABSTRACT

A new art form providing a plurality of optical images and illusions by the novel coaction of at least two diverse line and curve patterns disposed in spaced generally parallel relationship to each other, preferably with a frame.

20 Claims, 1 Drawing Sheet

ART FORM AND METHOD OF PRODUCING SAME

INTRODUCTION

The present invention relates generally to the creation and display of new art forms and more particularly to an art form in which dissimilar designs and patterns inscribed on transparencies are superimposed to each other to create interesting and unusual visual effects and illusions to a viewer which effects and illusions change as the viewer's vantage point is changed.

BACKGROUND OF THE INVENTION

The creation and display of new art forms has been the goal of artists since the beginning of man. Even early cave dwellers drew, painted, carved or sculptured images of animals and other representations of their environment on the walls of their caves. Some even incorporated the nodes occurring on the rocks or the veins and cracks disposed therein into their sketches and drawings.

Early man also discovered and used sticks, stones, berries and like portions of their surroundings to give form and color to their drawings. At each age through history the artists saw the possibilities of new discoveries and tools for the advancement of artistic expression.

Other art forms involve the congruous or incongruous arrangement of similar or dissimilar objects and things in a familiar or unfamiliar setting to produce an attention-getting and hopefully pleasing visual effect.

One recent example of such a mixture of objects and things to create an interesting visual effect is Picasso's "Bull's Head" (1943) which comprises a bronze cast of various bicycle parts in which the seat is used to suggest the animal's face and the handle bar suggests the animal's horns.

With the advent of the computer, even new challenges have arisen from the ability to quickly create mathematical representations which heretofore could only be manually plotted after hours of meticulous labor. One such phenomena is the so-called moire pattern.

Moire pattern generation has been discussed for a long time, e.g., *Scientific American,* May 1963 which described the use of such patterns in a variety of applications from measuring instruments to patterned fabric.

Rakowsky (U.S. Pat. No. 3,589,045) teaches the use of identical images spatially separated from each other while visually aligned so that the pattern when the angle created thereby varies when the angle of viewing is altered.

In our modern high-tech society there is a growing fascination with abstract and mathematical graphics and a need for an art form which depicts action in the terms of the scientific age. It is believed that the present invention fulfills that need.

BRIEF SUMMARY OF THE INVENTION

The present invention relates to a new art form which includes the use of Moire patterns applied in dual or multiple layers with or without spatial separation between layers. The pictures produced may be easily changed by pattern substitution, color application, or lighting modification.

Changing images are created by mounting a transparent pattern over a dissimilar opaque or tranparent pattern or etching, either spatially separated or in surface to surface contact. The patterns coact to produce interference lines of differing intensities which in turn creates a visual image which will change when the viewing angle is changed, or, in the case of the contact images, when the primary pattern is moved or a different pattern is substituted therefor.

The family of curves which can now be computer generated will, when displayed in accordance herewith, create interesting optical efforts. Furthermore, some curves even when generated by the same equation, will always be slightly dissimilar (one compared to another) because of the mechanistic nature of the reproduction by the printer.

The manipulation and positioning of the various geometric patterns which may be produced and printed or drawn, either on opaque or transparent media, as will appear, form the basis for the present invention. The display formed by assembling various patterns in accordance herewith may be hung, or if desired, readily changed by adding a different configuration on a transparency to the assemblage, by exchanging one of the existing panels for a panel bearing a different pattern, or by varying the distance and/or angular relationship between adjacent panels.

Furthermore, other interesting visual effects in shading and line or curve emphasis may be obtained by the use of various primary colors, either in the background and/or in the lines forming the image. Of course, additional variations and enhancement may be had through the use of appropriate interior or exterior lighting, with or without light and color movement, in association with the finished art work.

Accordingly, it is a primary object of the present invention to provide a novel and unique art form that produces a special "conversation piece" without incurring either the expense or the training of a professional artist.

A further object of the present invention is to provide a novel and unique art form that can be readily utilized in any dimension without detracting from the sense of action produced thereby.

Another object of the present invention is to provide a novel and unique art form which is readily adapted to the use of a variety of different colors to complement and enhance a given decor or to create a special spot of interest in a small space.

Still another object of the present invention is to provide a novel and unique art form and method of practicing the same which when followed by an individual of even modest artistic talent can result in an eyecatching and attractive decorative piece at a modest cost.

These and still further objects as shall hereinafter appear are readily fulfilled by the present invention in a remarkably unexpected manner as will be readily discerned from the following detailed description of an exemplary embodiment thereof, especially when read in conjunction with the accompanying drawing in which like parts bear like numerals throughout the several views.

DESCRIPTION OF THE PREFERRED EMBODIMENT

The present invention provides a new art form which is particularly adaptable to, though as will appear, not necessarily limited to, interior decoration and is identified by general reference 10. This art form is especially provocative because of its ability to provide the viewer an almost infinite variety of different illusions, depending on the viewer's angle of inspection; the disparity of the line or curve patterns employed; the almost endless choice of primary or secondary patterns which can be used; and the virtually infinite variety of spatial and angular relationship between adjacent patterns.

It will further appear that the present invention permits the production of art objects which allow white or colored internal or external lighting to be used therewith. It will be further noted that the several pattern lines may be in preselected colors and the background therefor can be created in colors which are complementary or contrasting therewith.

Figure 1:
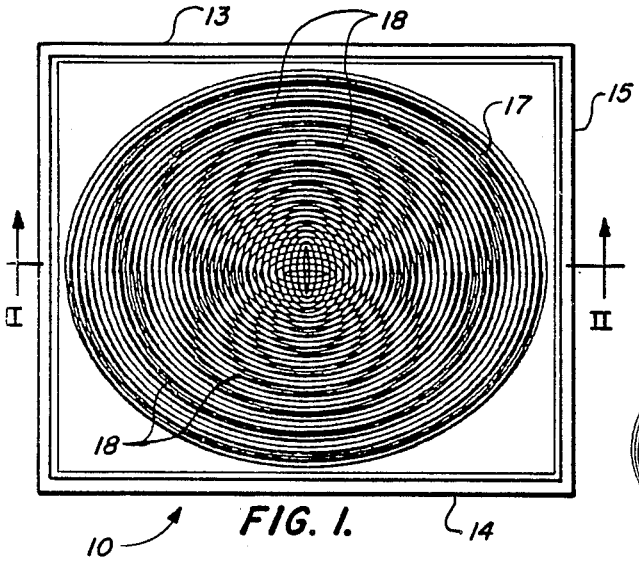
FIG. 1 is a frontal elevation of an artistic production produced in accordance with and embodying the present invention.
Figure 2:
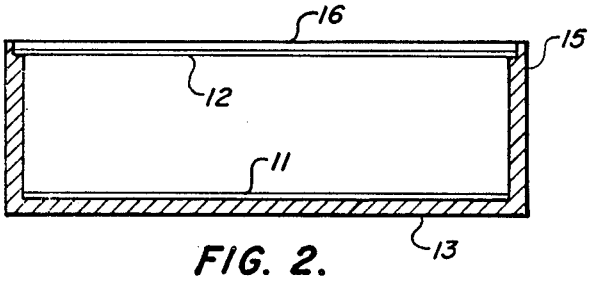
FIG. 2 is a cross section taken on line II—II of FIG. 1.

In one practice of the present invention as shown in FIG. 1, a first and second pattern are selected from the myriad of available patterns, for instance, patterns D and E as shown in FIG. 5.

One of the patterns, for instance pattern D, is drawn, projected or printed on an opaque sheet 11 of suitable material such, for instance, as the so-called Bristol® board used for patent drawings. Preferably, the pattern will be applied to the opaque board 11, either manually or with a computer printer, which is especially suited for converting mathematical equations into visual representations thereof.

The other pattern, here being pattern E, is drawn, printed or projected onto a transparent sheet 12, usually called "transparencies", which may be Mylar® or like plastic sheeting characterized by both its transparency and its dimensional stability.

The color of the ink for the several patterns is optional to the artist and a wide variety of colors are available in the so-called India ink formulations. It should also be noted that each pattern can be inscribed in the same or a different color ink, attention being given to the ultimate effect desired and the prevalent decorator colors employed in the area in which it will be displayed. Either complementary or contrasting colors are appropriate for use herewith.

Once an opaque sheet 11 and one or more transparencies 12 of comparable size have been prepared, they can be assembled to create an artistic display 10 embodying the present invention in the following fashion.

In one practice of the present invention, a display device 10 is created comprising an opaque backing sheet 11 upon which, according to the exemplary procedure described above, a suitable pattern such, for example, as pattern D has been inscribed and a single transparent sheet 12 upon which a second suitable pattern such, for example, as pattern E has been imprinted.

To create the special art form which typifies the present invention, backing sheet 11 is mounted at the rear of a shadow box frame 13 and transparent sheet 12 is then secured in spaced (circa ¼") generally parallel relationship to backing sheet 11 as by attaching the respective edges of sheet 12 to the sides 14 and ends 15 of frame 13. When desired, a pane of picture frame glass 16 can also be installed into frame 13 outwardly of transparency 12 to protect the work from dust and unwanted handling. When used, however, it is preferred that the so-called "glare proof" glass be used so as to not create unwanted reflections and glares which could detract from the overall visual effect of display device 10.

By faithfully following the foregoing procedure, an artistic display 10 as shown in FIG. 1 is created wherein the described interrelationship between patterns 5D and 5E creates a new image 17 having a plurality of fringe lines 18 disposed therewithin by the coaction of the various patterns and factors described herein.

It is of course understood that each combination of patterns chosen for display within device 10 will produce its own special image 17 having its own unique pattern of fringe lines 18.

Figure 3:
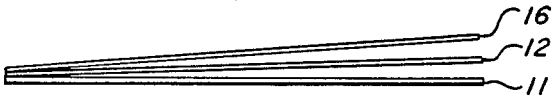
FIG. 3 is an end view of a dual pattern overlay prepared in accordance with the present invention.
Figure 4:
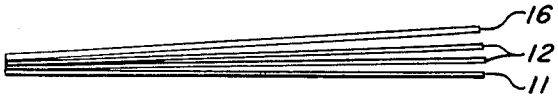
FIG. 4 is an end view of multiple pattern overlay prepared in accordance with the present invention.
Figure 5A:
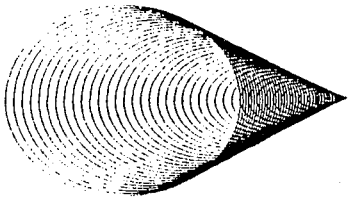
FIGS. 5A, 5B, 5C, 5D, 5E, 5F, 5G, 5H and 5I are frontal views of a variety of illustrative patterns which can be readily employed in the practice of the present invention.
Figure 5B:
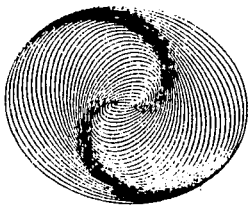
Figure 5C:
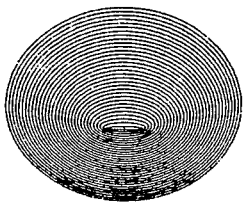
Figure 5D:
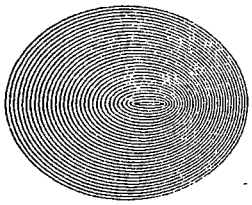
Figure 5E:
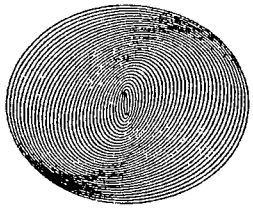
Figure 5F:
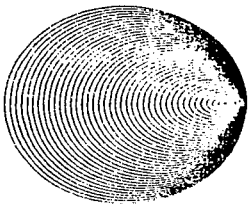
Figure 5G:
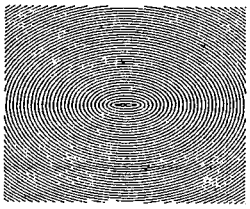
Figure 5H:
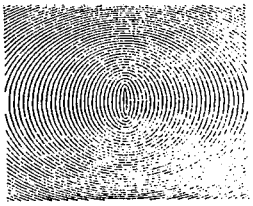
Figure 5I:
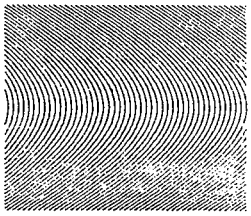
Figure 6:
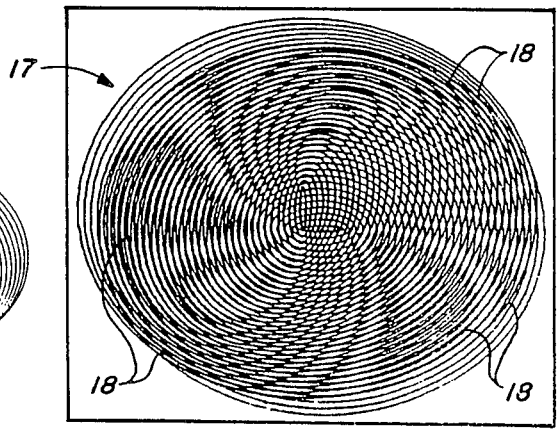
FIG. 6 is a frontal view of an art object produced in accordance herewith when both overlays involve ellipses.

Still different effects are created when the transparency is disposed other than parallel to the opaque backing sheet as shown in FIG. 3 or when more than one transparency is used as shown in FIG. 4.

It is further contemplated that the same principals hereof can be employed with frames which are open from both sides and only transparencies are secured therein to created a different visual effect from each window thereof. When created in a relatively smaller size, that is, from about three to about five inches across, or in diameter if a circular frame is used, such smaller objects can be suspended in groups to create a highly provocative and unusual mobile.

It is also contemplated that the principles set forth herein can be exploited in the manufacture of greeting cards, special packaging and like areas where attractive and thought-provoking designs are constantly sought.

Among the various patterns which have been created pursuant hereto and found to produce highly satisfactory results are the ellipses which, if concentric, are prepared according to the equation:

$$x = a \cos N$$

$$y = b \sin N$$

wherein:

a and b are constants for a given ellipse;

N varies from $0 \rightarrow 2\pi$ in small steps equal to: $\Delta N \approx \pi/100$ to provide a generally smooth curve. In a preferred practice, a and b will be incremented in small steps $\Delta a$ and/or $\Delta b$ such the the space between consecutive ellipses will always be within a factor of 10–20 times the width of the line generating the ellipses.

For non-concentric ellipses:

$$x = a \cos N$$

$$y_1 = b \sin N$$

which is the same as for the concentric ellipses except that the center of each successive ellipse is moved by a small increment $\Delta O_1$, along the x-axis, in either the positive or negative X-direction.

Another form of non-concentric ellipses is obtained using the equations:

$$x_1 = a \cos N \text{ and}$$

$$y = b \sin N$$

wherein:

a and b are constant for a given ellipse and

N varies from 0 to $2\pi$ with a $\Delta N \approx \pi/100$ as before except that here the center is moved by a small increment, $\Delta O_2$, along the y-axis, in either the positive or negative y-direction.

Still another form of non-concentric ellipse is obtained using the equations:

$$x_1 = a \cos N \text{ and}$$

$$y_1 = b \sin N$$

wherein:

a and b are constant for a given ellipse and N varies from 0 to $2\pi$ with $\Delta N \approx \pi/100$ as before except that the center of each successive ellipse is moved in the combined directions given by $\Delta O_1$ and $\Delta O_2$.

Other patterns found to provide interesting and attractive results when used with the present invention include concentric ellipses having the major axes oriented at a constant angle G relative to the x-axis so that $$\begin{aligned} x_1 &= a\cos N & & x = x_1\cos G - y_1\sin G \\ y_1 &= b\sin N & \& \quad & y = y_1\cos G + x_1\sin G \\ \text{or } x &= a\cos N\cos G - b\sin N\sin G & & y = b\sin N\cos G + a\cos N\sin G \end{aligned}$$

which can be further varied by rotating the axes of each successive ellipse through an incremental angle $\Delta G$.

Another useful figure in the practice of the present invention is the hyperbola which is derived by the formulae:

$$x = a/2\,(e^{L} + e^{-L}) \qquad \text{or} \quad X^2/a^2 - y^2/b^2 = 1$$

$$y = b/2\,(e^{L} - e^{-L})$$

Successive hyperbolae are generated by incrementing a and b in small steps $\Delta a$ and $\Delta b$, where $\Delta a$ can be less than, equal to, or greater than $\Delta b$. L is a constant. Similarly the origin can be translated and/or the axes can be rotated as described above. Sine waves, oriented in the x-direction, are produced by the equation:

$$y = c \sin\,[-2\pi(x+a)/(4a/3)]$$

Cosine waves, oriented in the y-direction, are created by the equation:

$$x = c \cos\,[\pi(y-b)/b].$$

The origin of these patterns can likewise be translated in increments in any direction, the axes rotated, the amplitude incremented in steps c and the wavelength varied by varying either a or b, depending on the particular effect desired.

Airfoils and other mathematical configurations as will readily occur to the artisan when confronted with this disclosure can also be employed to create a desirable visual effect.

From the foregoing, it is readily apparent that a new art form and method of producing the same has been herein described and illustrated which fulfills all of the aforestated objectives in a remarkably unexpected fashion. It is of course understood that such modifications, alterations and adaptations as may readily occur to the artisan confronted with this disclosure are intended within the spirit of the present invention which is limited only by the scope of the claims appended hereto.

Accordingly, what is claimed is:

1. A new art form comprising a backing sheet having a first precisely generated planar pattern imposed thereupon; a first transparent sheet having a second precisely generated planar pattern imposed thereupon, said second planar pattern being discernibly different from said first planar pattern and disposed in fixed relationship to said first planar pattern so that a viewer facing said transparent sheet from each of a plurality of vantage points observes a different one of a plurality of optical effects resulting from the visual coaction of said first pattern with said second pattern.

2. A new art form according to claim 1 in which said transparent sheet is disposed in generally parallel spaced relationship to said backing sheet.

3. A new art form according to claim 1 in which said first pattern comprises randomly generated lines.

4. A new art form according to claim 1 in which said first pattern comprises a geometrically generated pattern based on one of the generally recognized mathematical formulae.

5. A new art form according to claim 4 in which said mathematical formulae are for concentric ellipses, non-concentric ellipses, hyperbolae, sine waves, cosine waves, circles, and straight lines.

6. A new art form according to claim 1 in which said second pattern comprises randomly generated lines.

7. A new art form according to claim 1 in which said second pattern comprises a geometrically generated pattern based on one of the generally recognized mathematical formulae.

8. A new art form according to claim 7 in which said mathematical formulae are for concentric ellipses, non-concentric ellipses, hyperbolae, sine waves, cosine waves, circles, and straight lines.

9. A new art form according to claim 5 in which said second pattern comprises randomly generated lines.

10. A new art form according to claim 5 in which said second pattern comprises a geometrically generated pattern based on one of the generally recognized mathematical formulae.

11. A new art form according to claim 10 in which said second pattern comprises randomly generated lines.

12. A new art form according to claim 11 in which said transparent sheet is disposed in generally parallel spaced relationship to said backing sheet.

13. A new art form according to claim 2 in which said backing sheet and said transparent sheet are mounted in a shadow box frame.

14. A new art form according to claim 3 in which said backing sheet and said transparent sheet are mounted in a shadow box frame.

15. A new art form according to claim 8 in which said backing sheet and said transparent sheet are mounted in a shadow box frame.

16. A new art form according to claim 12 in which said backing sheet and said transparent sheet are mounted in a shadow box frame.

17. A new art form according to claim 1 having a second transparent sheet having a third pattern imposed thereupon disposed in fixed spaced relationship relative to said backing sheet and said first transparent sheet.

18. A new art form according to claim 17 in which said third pattern comprises randomly generated lines.

19. A new art form according to claim 18 in which said third pattern comprises a geometrically generated pattern based on one of the generally recognized mathematical formulae.

20. A new art form according to claim 19 in which said mathematical formula are for concentric ellipses, non-concentric ellipses, hyperbolae, sine waves, cosine waves, circles, and straight lines.

* * * * *